United States Patent [19]

Tsubai et al.

[11] Patent Number: 4,649,096

[45] Date of Patent: Mar. 10, 1987

[54] PROCESSING COMPOSITIONS FOR SILVER COMPLEX DIFFUSION TRANSFER PROCESS

[75] Inventors: Yasuo Tsubai; Koji Okazaki; Shoichi Horii; Akio Yoshida, all of Nagaokakyo, Japan

[73] Assignee: Mitsubishi Paper Mills, Ltd., Tokyo, Japan

[21] Appl. No.: 719,132

[22] Filed: Apr. 2, 1985

[30] Foreign Application Priority Data

Apr. 6, 1984 [JP] Japan ..... 59-69551
Apr. 6, 1984 [JP] Japan ..... 59-69552

[51] Int. Cl.[4] ..... G03C 5/54; G03C 5/30; G03C 5/38

[52] U.S. Cl. ..... 430/249; 430/251; 430/456

[58] Field of Search ..... 430/249, 251, 456

[56] References Cited

U.S. PATENT DOCUMENTS 3,684,512 8/1972 Cain ..... 430/456
4,147,543 4/1979 Kubotera et al. ..... 430/456
4,297,430 10/1981 Kanada et al. ..... 430/251
4,298,673 11/1981 Kubotera et al. ..... 430/249
4,310,613 1/1982 Iguchi et al. ..... 430/251
4,362,811 12/1982 Iguchi et al. ..... 430/251
4,568,634 2/1986 Hayashi ..... 430/249

*Primary Examiner*—Richard L. Schilling
*Attorney, Agent, or Firm*—Cushman, Darby & Cushman

[57] ABSTRACT

Disclosed is a processing composition for silver complex diffusion transfer process which contains the following constituents (A) to (E) or (A) to (F):

| | | |
|---|---|---|
| (A) | MOH (M is an alkali metal) | 0.05–0.2 mole/l |
| (B) | an alkanolamine | 0.25–0.7 mole/l |
| (C) | a sulfite | 0.4–0.7 mole/l |
| (D) | a thiosulfate | 0.03–0.08 mole/l |
| (E) | a p-dihydroxybenzene | ≧0.07 mole/l |
| (F) | a benzotriazole | $10^{-4}$–$10^{-2}$ mole/l, |

the sum of (A) and (B) being 0.4 to 0.8 mole/l and the molar ratio of (B) to (A) being above 2.0. This composition can produce images and tone without scumming.

16 Claims, No Drawings

PROCESSING COMPOSITIONS FOR SILVER COMPLEX DIFFUSION TRANSFER PROCESS

This invention relates to a processing composition used for silver complex diffusion transfer process and a method for carrying out silver complex diffusion transfer process using said processing composition.

The principle of the silver complex diffusion transfer process (hereinafter referred to as DTR process) is well known through the description in U.S. Pat. No. 2,352,014 and many other patents and literature. In DTR process, the silver complex is transferred imagewise by diffusion from the silver halide emulsion layer to an image receptive layer and converted into a silver image in the presence of physical development nuclei in most cases. For this purpose, the imagewise exposed silver halide emulsion layer is previously disposed in contact or is brought into contact with an image receptive layer in the presence of a developing agent and a silver halide solvent to convert the unexposed silver halide into a soluble silver complex. In exposed areas of the silver halide emulsion layer, the silver halide is developed to silver which is insoluble and non-diffusible. In unexposed areas of the silver halide emulsion layer, the silver halide is converted into soluble silver complex which is then transferred to the image receptive layer and forms a silver image, generally in the presence of development nuclei.

The DTR process is adaptable widely to the reproduction of documents, making of printing plate, making of block copy, and instant photography.

Especially in the reproduction of documents or the making of a block copy, a negative element bearing a silver halide emulsion layer and a positive element bearing an image receptive layer containing physical development nuclei are brought into close contact in the DTR processing composition usually containing a silver complex forming agent to form a silver image in the image receptive layer of the positive element. The silver image thus formed is required to be pure black or bluish black in color and should be of sufficient density. It is important for the silver image that the contrast and sharpness are high and the image reproducibility is good. A high transfer speed is also desirable. Further, it is necessary that the quality of the positive element be not dependent to a great extent upon the processing conditions (such as, for example, time and temperature) and not deteriorate by running processing (i.e. continued use of the processing composition).

In practice, the DTR process is generally carried out in a simple image-forming system. For instance, there is used a processor composed of a tray to hold a transfer-developing composition, squeeze rolls to bring a negative sheet and a positive sheet into close contact, and a motor to drive the squeeze rolls. Although various types have been designed and used in various countries of the world, the processors are generally operated at room temperature without temperature control except for special types, and are often different from one another in speed of conveyance and path length in a developer. From the principle of DTR process, it is easily understandable and also well known to the art that the process of image forming is affected to a great degree by the conditions of processing, particularly processing temperature and processing speed.

As examples of general effects excerted by the change in processing conditions of DTR process, especially by the change in processing temperature and conditions of conveyance, mention may be made of the following:

(1) Change in sensitivity, tone reproduction in gradation and color, and density (reflection and transmission densities).

(2) Low temperature processing tends to promote the staining (caused by the formation of fine grain silver colloid) of the image receptive sheet.

(3) An increase in processing temperature or a decrease in conveyance speed causes reduction in ability to reproduce micro images such as, for example, fine lines or fine spots.

The background reasons for the long neglect of the above problems despite their importance seem to originate in the general belief that the DTR process is difficult to control because it is made up on the basis of delictate balance among chemical development, dissolution, diffusion, and physical development.

Other practical problems of the DTR processing system originate in the circumstance such that each system has been commercialized in the form of a combination of negative element, positive element, and DTR processing composition; namely, the formulation and structure of the components have been developed so that the combination may meet to a certain degree the previously described quality requirements. There are used negative elements such as low sensitivity type for contact printing, high sensitivity type for camera work, and a type using a direct positive emulsion; positive elements such as a type utilizing reflection density and a type utilizing transmission density; and DTR processing compositions such as a type containing a developing agent and a type containing no developing agent. Combinations are made up from the negative and positive elements and processing compositions according to the method and mode of the particular use. Such a combination has a disadvantage in that if any one component of a combination of positive and negative elements and a processing composition selected to provide the best quality is replaced by a component of another combination, the best quality is no longer attained. It is desirable, therefore, if it is possible to find a general-purpose processing composition capable of providing excellent results when combined with any negative element and any positive element.

An object of this invention is to provide a processing composition and a method of processing to be used in the silver complex diffusion transfer process, which composition produces on the positive element a silver image excellent in density, contrast, resolution, and tone without accompanied scumming even if the negative and positive elements are varied in type and combination under varied processing conditions, even under running processing conditions.

It has now been found that the above object is achieved by a processing composition for the silver complex diffusion transfer process, which is characterized by containing in one liter at least the following constituents (A) to (E) and, if necessary, (F), the sum of (A) and (B) being 0.4 to 0.8 mole and the molar ratio of (B) to (A) being above 2.0:

| | | |
|---|---|---|
| (A) | MOH (M is an alkali metal) | 0.05–0.2 mole |
| (B) | an alkanolamine | 0.25–0.7 mole |
| (C) | a sulfite | 0.4–0.7 mole |
| (D) | a thiosulfate | 0.03–0.08 mole |
| (E) | a p-dihydroxybenzene | ≧0.07 mole |

-continued

| | | |
|---|---|---|
| (F) | a benzotriazole | $10^{-4}$-$10^{-2}$ mole |

The alkali agents (A) include sodium hydroxide, potassium hydroxide, etc.

The alkanolamines (B) include the compounds represented by the following general formula:

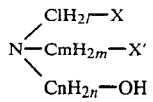

wherein X and X' represent each a hydrogen atom, hydroxyl group, or amino group, l and m represent each 0 or an integer of 1 or larger than 1, and n represents an integer of 1 or larger than 1.

As individual compounds, mention may be made of ethanolamine, diethanolamine, triethanolamine, diisopropanolamine, N-methylethanolamine, N-aminoethylethanolamine, and N,N-diethylethanolamine etc., especially preferred are secondary or tertiary alkanolamines.

The sulfites (C) include sodium sulfite, sodium hydrogensulfite, etc.

The thiosulfates (D) include sodium thiosulfate, potassium thiosulfate, etc.

The p-dihydroxybenzenes (E) include hydroquinone, chlorohydroquinones, methylhydroquinones, etc.

The benzotriazoles (F) include the compounds represented by the following general formula:

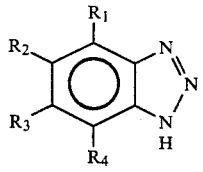

wherein $R_1$, $R_2$, $R_3$ and $R_4$ represent each a hydrogen atom, alkyl group, alkoxy group, halogen atom, acylamide group, sulfonamide group, cyano group, sulfo group, carboxyl group, alkoxycarbonyl group, aryl group, nitro group, aminocarbonyl group, or

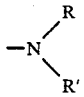

group, where R and R' represent each a hydrogen atom or alkyl group.

As individual compounds, mention may be made of the following:

(1) Benzotriazole
(2) 5-Methylbenzotriazole
(3) 5,6-Dimethylbenzotriazole
(4) 5-Phenylbenzotriazole
(5) 5-Ethylbenzotriazole
(6) 5-Methoxybenzotriazole
(7) 5-Aminobenzotriazole
(8) 5-Dimethylaminobenzotriazole
(9) 5-Acetamidobenzotriazole
(10) 5-Methanesulfonamidobenzotriazole
(11) 5-Aminocarbonylbenzotriazole
(12) 5-Methoxycarbonylbenzotriazole
(13) 5-Carboxybenzotriazole
(14) 5-Chlorobenzotriazole
(15) 5-Bromobenzotriazole
(16) 5-Nitrobenzotriazole
(17) 4-Nitrobenzotriazole
(18) 5-Cyanobenzotriazole
(19) 5-Sulfobenzotriazole
(20) 4-Aminobenzotraizole Although being well-known compounds, the constituents (A) to (F) have heretofore not been examined for the same purpose as that of the present invention. As a consequence, it has been only possible to obtain a defective processing composition as shown hereinafter.

The constituents (A) and (B) constitute substantially the alkali component of the present processing composition. However, if necessary, other alkali chemicals such as sodium carbonate can be added unless the total alkalinity will not surpass the maximum alkalinity attainable with (A) and (B) under the conditions as specified above with respect to individual and total amounts and molar ratio. The pH is in the range of from about 10.0 to about 12.5.

The specified amount of the alkali agent (A) is smaller than that customarily used. Owing to the coexistence of an alkanolamine (B), if the alkali agent (A) is increased beyond 0.2 mole/liter (8 g/liter in terms of NaOH) in the case of high temperature development, e.g. at 30° C., there will occur a decline in transmission density as well as in the ability of forming micro images, and, in the case of running processing, yellow staining of the white background of a positive element. A suitable amount of alkali agent (A) is in the range of from 0.1 to 0.2 mole/liter.

The use of alkanolamines (B) in processing compositions for the DTR process is described, for example, in Japanese Patent Application "Kokai" (Laid-open) No. 93,338/73, in which are also shown various advantageous functions of alkanolamines. However, it is seen from Examples 1 and 2 of said Application that when a sulfite is used as a preservative, the transmission density becomes markedly decreased with the increase in the amount of alkanolamines.

The present inventors carried out a large number of experiments and, as a result, it was found that the above difficulties are substantially overcome and the density decrease or the yellow staining is minimized under the conditions of running processing, by reducing the amount of an alkali agent (A), increasing the molar ratio of an alkanolamine (B) to 2.0 or above for 1 mole of (A), and limiting the sum of (A) and (B) to 0.4 to 0.8 mole/-liter so that an excessive addition of (B) may be avoided, as described above. The molar ratio of an alkanolamine (B) to an alkali agent (A) is 2.0 or above, preferably 2.5 or above. The yellow stain formed on the white background, which is one of the disadvantages due to the use of an alkali agent (A) in abundance is considered to be originated from the colloidal silver as described in Japanese Patent Application "Kokai" (Laid-open) No. 116,536/83 for example.

By using a sulfite (C) in an amount of 0.4 to 0.7 mole/-liter, it was found that the density is improved and the yellow staining under the conditions of running processing is also avoided to a large extent. The developing agent hydroquinone is oxidized by the running processing to form a so-called sulfate salt by the addition of a sulfite to cause a decline in developing power, resulting in yellow staining. In order to maintain a sufficient developing power, a large amount of the sulfite is used depending on 0.07 mole/liter or more, preferably 0.08 mole/liter or more of the developing agent p-dihydroxybenzene (E). A preferable amount of the sulfite is 0.4 to 0.60 mole/liter. A preferable molar ratio of the sulfite (C) to the p-dihydroxybenzene (E) is in the range of from 3.5 to 5.5.

The processing composition of this invention preferably contains 1-phenyl-3-pyrazolidone or a derivative thereof in addition to a p-dihydroxybenzene (E). The object of this invention can also be achieved by the inclusion of 1-phenyl-3-pyrazolidone in negative or/and positive elements. A preferable amount of 1-phenyl-3-pyrazolidone is in the range of from $2\times10^{-3}$ to $2\times10^{-2}$ mole/liter.

The thiosulfate (D) is also an important factor to achieve the object of this invention. Although depending upon the amounts of other constituents (A), (B), (C) and (E) or (F), the amount of a thiosulfate is generally in the range of from 0.03 to 0.08 mole/liter (from about 7 to 20 g/liter in terms of sodium thiosulfate pentahydrate), preferably from 0.04 to 0.07 mole/liter (from about 10 to 17 g/liter in terms of sodium thiosulfate pentahydrate).

The disadvantages caused by the presence of an excessive amount of a thiosulfate include a decline in transmission density or in reproducibility of micro images when the processing composition is used at high temperatures (28° C. or above) or in a processor of low conveyance.

It is possible to use a thiosulfate in combination with other silver halide solvents such as thiocyanate salts.

The benzotriazoles (F) are known as antifoggant. It is described in Japanese Patent Application "Kokai" (Laid-open) No. 79,445/80 that the density decline accompanying the high speed processing is prevented by the potassium ion concentration and the antifogging action of a bromide. However, the bromide was found to have various disadvantages such as a large change in density with the change in processing temperature, a large degree of staining in the running processing, and a reddish tone of the silver image depending upon the type of negative element.

It was found that in order to achieve effectively the object of this invention without adversely affecting the characteristics of a processing composition containing the constituents (A) to (E), it is important to use a benzotriazole as the antifoggant. As compared with equivalent moles of potassium bromide, benzotriazole acts as a better antifoggant, shows optical density maximum in the range of from $10^{-4}$ to $10^{-2}$ mole/liter when the content is varied, is higher in optical density and lower in the dependency upon processing temperature. Moreover, benzotriazole produces less stain in the running processing, gives a desirable black silver image independent of the type of negative element, and improves the ability of micro image formation. Best results are obtained especially for a black silver image by using a benzotriazole in combination with mercapto compounds such as 1-phenyl-5-mercaptotetrazole, 2-mercaptobenzoimidazole, and 2-mercapto-5-phenyl-1,3,4-thiadiazole, though these mercapto compounds do not give good results when used alone.

The processing composition may contain, if necessary, inorganic antifoggants such as potassium bromide and potassium iodide. This invention does not exclude the joint use with these compounds.

As described in the foregoing, the present processing composition is an autocome of the extensive research to find a general-purpose processing composition containing essential constituents (A) to (E) or (A) to (F), which composition produces a high quality image for any combination of materials. The present processing composition guarantees a silver image of highest quality for any negative element, positive element, and combination thereof without needing the change of the composition, indicating the usefulness of this invention.

The processing composition of this invention preferably contains 1-phenyl-3-pyrazolidone or a derivative thereof in addition to a p-dihydroxybenzene (E). The object of this invention can also be achieved by the inclusion of 1-phenyl-3-pyrazolidone in negative or/and positive elements. A preferable amount of 1-phenyl-3-pyrazolidone is in the range of from $2\times10^{-3}$ to $2\times10^{-2}$ mole/liter. A thiosulfate salt (D) is also an important factor to carry out favorably the DTR process. A preferable amount of thiosulfate is in the range of from 0.03 to 0.08 mole/liter in view of transmission density, reflection dnesity, and tone. It is possible to use a thiosulfate in combination with other silver halide solvents such as thiocyanate salts.

The processing composition preferably contains antifoggants. As examples of antifoggants, mention may be made of inorganic antifoggants such as potassium bromide and potassium iodide and organic antifoggants such as 1-phenyl-5-mercaptotetrazole, 2-mercaptobenzoimidazole, 2-mercapto-5-phenyl-1,3,4-thiadiazole, and imidazole derivatives.

The amount of an antifoggant can be varied in relatively broad range. The optimum amount should be determined by taking into account the nature of the compound, that is, whether it is inorganic, such as potassium bromide, or organic, such as 1-phenyl-5-mercaptotetrazole. A suitable amount is generally in the range of from $1\times10^{-4}$ to $1\times10^{-1}$ mole/liter.

The processing composition of this invention may further contain thickners, e.g. carboxymethylcellulose and hydroxyethylcellulose; development modifiers, e.g. polyoxyalkylene compounds and quaternary ammonium salts; and water softeners, e.g. sodium hexametaphosphate and EDTA.

The processing conditions for the present processing composition, such as time and temperature, vary depending upon various factors such as, for example, constituents of the photographic elements and constituents of the processing composition, though subject to no special restriction.

The negative element generally used in DTR process carries on a support at least one silver halide emulsion layer containing 0.5 to 3.5 g/m$^2$ of silver halide in terms of silver nitrate. Beside the silver halide emulsion layer, there are provided, if necessary, auxiliary layers such as subbing layer, interlayer, protective layer, and stripping layer. For instance, in order to ensure uniform transfer, the emulsion layer of the negative element can be provided with an overcoating layer of water-permissible binders as described in Japanese Patent Publication Nos. 18,134/63 and 18,135/63, such as, for example, methylcellulsoe, sodium salt of carboxymethylcellulose, and sodium alginate. The overcoating layer should be sufficiently thin so as not to interfere with or retard the diffusion. The silver halide emulsion layer of a negative element and the image receptive layer of a positive element contain one or more hydrophilic colloidal substances such as, for example, gelatin or derivatives thereof, e.g. phthalated gelatin; cellulose derivatives, e.g. carboxymethylcellulose and hydroxymethylcellulose; dextrin, soluble starch, polyvinyl alcohol, and polystyrenesulfonic acid.

The silver halide emulsion comprises hydrophilic colloids and, dispersed therein, silver halides such as, for example, silver chloride, silver bromide, silver chlorobromide, and these halides containing iodide. The silver halide emulsion may be sensitized in various ways during its manufacture or before coating. It can be chemically sensitized in a manner well known to the art with sodium thiosulfate, alkylthioureas, gold compounds, e.g. gold rhodanide and gold chloride, or a combination of these compounds. The emulsion is further sensitized generally for the region of from about 530 to about 560 nm, though can be panchromatically sensitized. A direct positive silver halide emulsion can also be used.

The silver halide emulsion layer and/or the image receptive layer can contain any of the compounds generally used in carrying out the DTR process. Such compounds include antifoggants, e.g. tetrazaindene and mercaptotetrazole; coating aids, e.g. saponin and polyalkylene oxide; hardeners, e.g. formaldehyde and chrome alum; and plasticizers. A developing agent can also be included. The supports used in negative or positive elements are those which are customarily used, including paper, glass, film, e.g. cellulsoe acetate film, polyvinylacetal film, polystyrene film, or polyethylene terephthalate film; metal supports overlaid with paper; paper supports coated on one or both sides with an α-olefin polymer, e.g. polyethylene. The positive element can contain physical development nuclei, e.g. heavy metals or sulfides thereof. One or more layers of a positive element can contain those substances which play an important role in the formation of diffusion transfer images described in Brit. Patent No. 561, 875 and Belg. Pat. No. 502,525, e.g. 1-phenyl-5-mercaptotetrazole. The positive element can also contain a fixing agent such as sodium thiosulfate in an amount of about 0.1 to about 4 g/m$^2$.

The invention is illustrated below in detail with reference to Examples, but the invention is not limited thereto.

EXAMPLE 1

Positive Element A

This element was prepared in the following manner: On one side of a paper support, 110 g/m$^2$ in basis weight, which had been coated on both sides with polyethylene, there was provided, at a coverage of 3 g/m$^2$ on dry basis, an image receptive layer comprising gelatin and a product made from polyvinyl alcohol and an ethylenemaleic anhydride copolymer, which contained palladium sulfide nuclei.

Positive Element B

This element was prepared in the following manner: On a polyethylene terephthalate film, there was provided, at a coverage of 3 g/m$^2$, an image receptive layer of hardened gelatin containing palladium sulfide nuclei.

Negative Element M

This element was prepared in the following manner: On the same paper support as used in positive element A, there was provided a subbing layer containing carbon black to prevent halation and overlaid with an orthochromatically sensitized gelatino silver halide emulsion layer containing 2.0 g/m$^2$ (in terms of silver nitrate) of silver chlorobromide (10% bromide), 0.3 μ in average grain size.

Negative Element N

A silver halide negative element N for the direct positive image was prepared by using the reference emulsion B described in Example 1 of Japanese Patent Application "Kokai" (Laid-open) No. 96,331/82 in place of the emulsion of the negative element M described above.

The following processing compositions 1–11 were prepared as DTR processing compositions.

The numerals in the table indicate mol per 1 l.

Unit: mole/liter

| | 1 | 2 | 3 | 4 | 5 | 6 | 7 | 8 | 9 | 10 | 11 |
|---|---|---|---|---|---|---|---|---|---|---|---|
| NaOH | 0.15 | 0.15 | 0.15 | 0.15 | 0.025 | 0.1 | 0.25 | 0.075 | 0.15 | 0.15 | 0.15 |
| MAE[1] | 0.2 | 0.4 | 0.55 | 0.7 | 0.4 | 0.4 | 0.4 | 0.55 | 0.4 | 0.4 | 0.4 |
| SS[2] | 0.5 | 0.5 | 0.5 | 0.5 | 0.5 | 0.5 | 0.5 | 0.5 | 0.35 | 0.5 | 0.5 |
| HP[3] | 0.06 | 0.06 | 0.06 | 0.06 | 0.06 | 0.06 | 0.06 | 0.06 | 0.06 | 0.1 | 0.02 |
| o . . . this invention | — | o | o | — | — | o | — | o | — | — | — |

Note:
[1]MAE stands for N—methylethanolamine,
[2]SS for anhydrous sodium sulfite, and
[3]HP for sodium thiosulfate pentahydrate.

Each processing composition contained, in common, 1 g of ethylenediaminetetraacetic acid, 12 g of hydroquinone, 1 g of 1-phenyl-3-pyrazolidone, 50 mg of 1-phenyl-5-mercaptotetrazole, 50 mg of potassium iodide, 1.0 g of potassium bromide, and 3 g of hydroxyethylcellulose per liter.

After imagewise exposure, negative elements M and N were coupled with positive elements A and B and processed in Dialine S-III processor (Trademark for a common DTR processor of Mitsubishi Paper Mills, Ltd.). After 60 seconds, each couple was peeled apart.

Maximum densities (reflection density for positive element A and transmission density for positive element B) obtained when processed at 20° C. and 30° C. were as shown in Table 1 and Table 2, respectively.

TABLE 1

| | | 20° C. | | | | | | | | | | |
|---|---|---|---|---|---|---|---|---|---|---|---|---|
| Negative element | Positive element | 1 | 2 | 3 | 4 | 5 | 6 | 7 | 8 | 9 | 10 | 11 |
| M | A | 1.66 | 1.66 | 1.65 | 1.60 | 1.66 | 1.68 | 1.60 | 1.65 | 1.60 | 1.70 | 1.50 |
| M | B | 3.6 | 4.4 | 4.0 | 3.6 | 4.0 | 4.6 | 3.8 | 4.0 | 4.2 | 3.8 | 2.8 |

TABLE 1-continued

| Negative element | Positive element | 1 | 2 | 3 | 4 | 5 | 6 | 7 | 8 | 9 | 10 | 11 |
|---|---|---|---|---|---|---|---|---|---|---|---|---|
| | | 20° C. | | | | | | | | | | |
| N | B | 2.8 | 3.6 | 3.4 | 3.3 | 3.0 | 3.8 | 3.2 | 3.2 | 3.0 | 3.4 | 2.2 |

TABLE 2

| Negative element | Positive element | 1 | 2 | 3 | 4 | 5 | 6 | 7 | 8 | 9 | 10 | 11 |
|---|---|---|---|---|---|---|---|---|---|---|---|---|
| | | 30° C. | | | | | | | | | | |
| M | A | 1.64 | 1.66 | 1.63 | 1.58 | 1.66 | 1.66 | 1.58 | 1.65 | 1.55 | 1.68 | 1.55 |
| M | B | 3.8 | 4.0 | 3.6 | 2.7 | 4.0 | 4.4 | 3.0 | 3.8 | 4.0 | 2.8 | 3.0 |
| N | B | 3.0 | 3.4 | 3.0 | 2.6 | 3.4 | 3.4 | 2.8 | 3.4 | 3.0 | 2.8 | 2.5 |

After having been left standing for 3 and 7 days, each processing composition was used for processing 20 couples of negative and positive elements, each A-4 in size. The density of image areas and yellow staining in non-image areas of 20th positive element processed in the processing composition which had been left standing for 7 days were recorded according to the following criteria:

o Entirely no staining.

Δ Local staining x Staining all over the element.

The results were as shown in Table 3.

The transfer processor was OSP-12 (Trademark for Mitsubishi Paper Mills, Limited) of the variable conveying speed type. The processing time was varied, while the time of transfer was set at 60 seconds.

The original bore fine lines from 10 μ to 100 μ (at an interval of 10 μ). Exposure was controlled through an optical wedge of the reflection type. The micro image forming ability was evaluated by inspecting the fine line image formation. The original was photographed at 70% reduction.

Evaluation of the tolerance of processing composition:

TABLE 3

| Negative element | Positive element | 1 | | 2 | | 3 | | 4 | | 5 | | 6 | | 7 | | 8 | | 9 | | 10 | | 11 | |
|---|---|---|---|---|---|---|---|---|---|---|---|---|---|---|---|---|---|---|---|---|---|---|---|
| | | (20° C.) | | | | | | | | | | | | | | | | | | | | | |
| M | A | 1.55 | x | 1.65 | o | 1.66 | o | 1.55 | o | 1.65 | Δ | 1.62 | o | 1.62 | Δ | 1.62 | o | 1.56 | x | 1.65 | o | 1.60 | Δ |
| M | B | 2.8 | x | 3.6 | o | 3.8 | o | 3.6 | o | 3.0 | Δ | 3.5 | o | 3.0 | Δ | 3.5 | o | 2.2 | x | 3.5 | o | 1.8 | Δ |
| N | B | 2.2 | x | 3.0 | Δ | 3.0 | o | 2.8 | Δ | 2.2 | Δ | 2.8 | Δ | 2.0 | x | 2.8 | o | 1.6 | x | 3.0 | o | 1.2 | Δ |

From Tables 1, 2 and 3, it is seen that all of the processing compositions other than those of this invention, 2, 3, 6 and 8, showed one or other disadvantages, such as low density and yellow staining, which vary according to the type of elements, processing temperature, and running processing, indicating that such processing compositions are not to be called general-purpose compositions.

The processing compositions of this invention, 2, 3, 6 and 8, gave best results independent of the processing conditions. The silver image formed were of high contrast and pure black in color.

EXAMPLE 2

Processing compositions were prepared according to the same formations as those of the processing compositions 1 to 11 in Example 1, except that the N-methylethanolamine was replaced by diethanolamine or N,N-diethylethanolamine. The processing compositions gave the results similar to those obtained in Example 1.

EXAMPLE 3

Positive element A, positive element B, negative element M and negative element N were prepared in the same manner as in Example 1.

The negative elements M and N were each mounted in a common process camera, then imagewise exposed, and brought into close contact with the positive elements A and B, respectively, to effect the image transfer.

The temperature of processing composition was varied in three stages of 16, 23, and 30° C. The retention time of negative elements in the processing composition was varied in three stages of 4, 6, and 9 seconds by varying the conveying speed.

Evaluation by running processing:

Sixty sets of the negative elements M and positive elements A, both A-4 in size, were processed in 2 liters of developer. The processing composition was then left standing for 10 days, while being exposed to the atmosphere. Then, various combinations of the negative and positive elements were subjected to transfer treatment and evaluated for the characteristics (transmission and reflection densities). The staining, color, and tone were visually evaluated.

The composition of developer was as shown in Table 4. Processing compositions A and B were in accordance with the present invention.

TABLE 4

| Composition of developer | A | B |
|---|---|---|
| Sodium hydroxide (g) | 4 | " |
| Sodium sulfite, anhydrous (g) | 60 | " |
| Sodium thiosulfate, $5H_2O$ (g) | 15 | " |
| Hydroquinone (g) | 12 | " |
| 1-Phenyl-3-pyrazolidone (g) | 1 | " |
| Potassium iodide (g) | 0.05 | " |
| N—methylethanolamine (g) | 30 | " |
| Benzotriazole (g) | 0.1 | 0.3 |
| Tetra-n-butylammonium bromide (g) | 2 | " |
| 1-Phenyl-5-mercaptotetrazole (g) | 0.05 | " |

TABLE 4-continued

| Composition of developer | A | B |
|---|---|---|
| Made up with water to | 1 l | " |

The results of processing were as summarized in Table 5. In this experiment, the conveying speed of the processor was set so that the retention time of the negative element in the processing composition may become 6 seconds.

TABLE 5

| Item of evaluation | Results (Neg.) | (Pos.) | Processing composition A | B |
|---|---|---|---|---|
| Transmission density | | | | |
| 16° C. | M | B | 4.2 | 4.0 |
| 23° C. | M | B | 4.5 | 4.5 |
| 30° C. | M | B | 4.2 | 4.3 |
| 23° C. | N | B | 3.8 | 3.6 |
| Yellow staining of background of positive element | | | | |
| 16° C. | M | A | o | o |
| 16° C. | N | A | o | o |
| Reflection density | | | | |
| 23° C. | M | A | 1.64 | 1.66 |
| Half tone color | | | | |
| 23° C. | M | A | Cold black | Cold black |
| 23° C. | N | A | Warm black | Warm black |
| Relative sensitivity (%) to exposure in camera | | | | |
| 16° C. | M | A | 90 | 90 |
| 23° C. | M | A | 100 | 100 |
| 30° C. | M | A | 120 | 120 |
| Micro image forming ability (μ) | | | | |
| 16° C. | M | A | 24 | 22 |
| 23° C. | M | A | 26 | 26 |
| 30° C. | M | A | 30 | 28 |

The processing compositions of the present invention, A and B, showed a high transmission density, sufficient stability against the change in processing temperature, no staining in the processing at low temperatures, desirable half tone color, reduced temperature dependency of the practical printing sensitivity (expressed in relative sensitivity, assuming the sensitivity in processing at 23° C. to be 100), and excellent ability of forming micro images.

In another experiment, it was confirmed that the processing compositions A and B according to this invention showed little yellow staining of the background under the conditions of high conveying speed at low temperatures, and very little decline in micro image forming ability under the conditions of low conveying speed at high temperatures.

The results of evaluation of the transferred image obtained in running processing (exhausted composition) were as summarized in Table 6.

TABLE 6

Results of running processing (exhausted composition). Conveying speed: 6 seconds in retention time.

| Item of evaluation | (Neg.) | (Pos.) | Processing composition A | B |
|---|---|---|---|---|
| Transmission density | | | | |
| 16° C. | M | B | 3.2 | 3.0 |
| 16° C. | N | B | 2.8 | 2.8 |
| Yellow staining of background of positive element | | | | |
| 23° C. | M | A | o | o |

TABLE 6-continued

Results of running processing (exhausted composition). Conveying speed: 6 seconds in retention time.

| Item of evaluation | (Neg.) | (Pos.) | Processing composition A | B |
|---|---|---|---|---|
| 23° C. | N | A | o | o |
| Half tone color | | | | |
| 23° C. | M | A | Cold black | Cold black |
| Gradation | | | | |
| 23° C. | M | A | Hard | Hard |

The processing compositions of this invention were found to give good results in the running processing.

EXAMPLE 4

Using negative element M and positive elements A and B, a number of processing compositions shown in the following table were tested in a manner similar to that in Example 3. In the following table, there are also shown in generalized form the results obtained in high temperature processing (30° C.; conveying speed corresponding to a retention time of 6 seconds; transmission density was used for the evaluation), low temperature processing (16° C.; conveying speed corresponding to a retention time of 4 seconds; the yellow staining of the background was used for the evaluation), and running processing (the yellow staining of the background was used for the evaluation, as in Example 3).

| | A | $C_1$ | $C_2$ | $C_3$ | $C_4$ |
|---|---|---|---|---|---|
| Sodium hydroxide | 4 | 12 | 4 | 4 | 4 |
| Sodium sulfite, anhydrous | 60 | 60 | 60 | 60 | 40 |
| Sodium thiosulfate, $5H_2O$ | 15 | 15 | 15 | 24 | 15 |
| Hydroquinone | 12 | 12 | 12 | 12 | 12 |
| 1-Phenyl-3-pyrazolidone | 1 | 1 | 1 | 1 | 1 |
| Potassium iodide | 0.05 | 0.05 | 0.05 | 0.05 | 0.05 |
| Benzotriazole | 0.1 | 0.1 | 0.1 | 0.1 | 0.1 |
| Tetra-n-butylammonium bromide | 2 | 2 | 2 | 2 | 2 |
| 1-Phenyl-5-mercaptotetrazole | 0.05 | 0.05 | 0.05 | 0.05 | 0.05 |
| N—methylethanolamine | 30 | 30 | 15 | 30 | 30 |
| Made up with water to | 1 l | " | " | " | " |
| Results: | | | | | |
| High temperature processing (30° C.) | o | x | o | x | o |
| Low temperature processing (16° C.) | o | o | x | o | x |
| Running processing | o | Δ | x | o | x |

All of the processing compositions, except for A of this invention, revealed one or other difficult problem.

The present Example showed that the object of this invention can be achieved only with a processing composition of limited formulation.

EXAMPLE 5

Desirable results were obtained with a processing composition of the same formulation as that of A in Example 3, except that the N-methylaminoethanol was replaced by diethanolamine or N,N-diethylaminoethanol.

EXAMPLE 6

Desirable results were obtained with a processing composition of the same formulation as that of A in Example 3, except that the benzotriazole was replaced by 5-methylbenzotriazole or 5-chlorobenzotriazole.

What is claimed is:

1. A processing composition for silver complex diffusion transfer process which contains the following constituents (A) to (E):

| | | |
|---|---|---|
| (A) | MOH (M is an alkali metal) | 0.05–0.2 mole/l |
| (B) | an alkanolamine | 0.25–0.7 mole/l |
| (C) | a sulfite | 0.4–0.7 mole/l |
| (D) | a thiosulfate | 0.03–0.08 mole/l |
| (E) | a p-dihydroxybenzene | ≧0.07 mole/l |

the sum of (A) and (B) being 0.4 to 0.8 mole/l and the molar ratio of (B) to (A) being above 2.0, the alkali component of the processing composition consisting essentially of said constituents (A) and (B).

2. A processing composition according to claim 1 wherein (A) is sodium hydroxide or potassium hydroxide.

3. A processing composition according to claim 1 wherein (B) is an alkanoleamine represented by the following general formula;

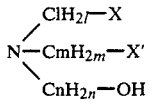

wherein X and X′ represent each a hydrogen atom, hydroxyl group, or amino group, l and m represent each 0 or an integer of 1 or larger than 1, and n represents an integer of 1 or larger than 1.

4. A processing composition according to claim 1 wherein (D) is sodium thiosulfate or potassium thiosulfate.

5. A processing composition according to claim 1 wherein (E) is hydroquinones, chlorohydroquinones or methylhydroquinones.

6. A processing composition according to claim 1 which contains 1-phenyl-3-pyrazolidone in addition to (E).

7. A processing composition according to claim 1 which additionally contains (F) $10^{-4}$ to $10^{-2}$ mole of a benzotriazol.

8. A processing composition according to claim 7 wherein the benzotriazol (F) is represented by the following general formula:

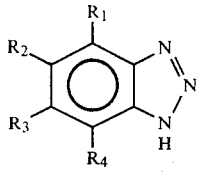

wherein $R_1$, $R_2$, $R_3$, and $R_4$ represent each a hydrogen atom, alkyl group, alkoxy group, halogen atom, acylamide group, sulfonamide group, cyano group, sulfo group, carboxyl group, alkoxycarbonyl group, aryl group, nitro group, aminocarbonyl group, or

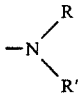

group, where R and R′ represent each a hydrogen atom or alkyl group.

9. A processing composition according to claim 8 wherein the benzotriazol is used in combination with a mercapto compound.

10. A processing composition according to claim 7 containing 0.4 to 0.60 mole/liter of sulfite.

11. A silver complex diffusion transfer process which comprises imagewise exposing a silver halide emulsion layer and then developing it with the processing composition of claim 1 to transfer silver complex imagewise produced to an image receiving layer.

12. A processing composition according to claim 1 wherein the molar ratio (B) to (A) is 2.5 or above.

13. A processing composition according to claim 1 which has a pH of from about 10.0 to about 12.5.

14. A processing composition according to claim 13 wherein the molar ratio (B) to (A) is 2.5 or above.

15. A processing composition according to claim 14 wherein the molar ratio of sulfite to p-dihydroxybenzene is from 3.5 to 5.5.

16. A processing composition according to claim 1 wherein the molar ratio of sulfite to p-dihydroxybenzene is from 3.5 to 5.5.

* * * * *